US005325104A

United States Patent [19]

Harada et al.

[11] Patent Number: 5,325,104

[45] Date of Patent: Jun. 28, 1994

[54] WHIP ANTENNA FOR USE IN VEHICLES

[75] Inventors: Jiro Harada, Tokyo; Masaki Shinkawa, Kanagawa, both of Japan

[73] Assignee: Harada Kogyo Kabushiki Kaisha, Tokyo, Japan

[21] Appl. No.: 964,123

[22] Filed: Oct. 21, 1992

Related U.S. Application Data

[63] Continuation of Ser. No. 632,409, Dec. 21, 1990, abandoned, which is a continuation of Ser. No. 460,295, Jan. 3, 1990, abandoned.

[51] Int. Cl.[5] ..... H01Q 1/32

[52] U.S. Cl. ..... 343/715; 343/906; 343/888

[58] Field of Search ..... 343/715, 888, 900, 906; 439/916; 174/153 A, 152 A, 138 A; H01Q 1/32, 1/50

[56] References Cited

U.S. PATENT DOCUMENTS

| | | | |
|---|---|---|---|
| 2,875,442 | 2/1959 | Benis et al. | 343/889 |
| 3,944,722 | 3/1976 | Larsen | 343/715 |
| 4,186,401 | 1/1980 | Altmayer | 343/715 |
| 4,632,354 | 12/1986 | Asciutto | 343/715 |

FOREIGN PATENT DOCUMENTS

| | | | |
|---|---|---|---|
| 564112 | 9/1958 | Canada | 343/900 |
| 2357542 | 2/1975 | Fed. Rep. of Germany | 343/715 |
| 660913 | 11/1951 | United Kingdom | 343/900 |
| 2035699 | 6/1980 | United Kingdom | 343/715 |

*Primary Examiner*—Michael C. Wimer
*Attorney, Agent, or Firm*—Koda and Androlia

[57] ABSTRACT

A whip antenna for vehicles including an antenna element with a skirt-form coupling member provided on the antenna element. The coupling member is, at a predetermined point on the antenna, prevented from moving toward the lower end of the antenna and has a screw thread on its inner surface. The lower end of the antenna is inserted into an antenna attachment base installed in a vehicle body, and the coupling member is screwed to this antenna attachment base.

5 Claims, 3 Drawing Sheets

WHIP ANTENNA FOR USE IN VEHICLESThis is a continuation of application Ser. No. 632,409, filed Dec. 21, 1990 now abandoned, which is a continuation of application Ser. No. 460,295 filed Jan. 3, 1990 abandoned.

BACKGROUND OF THE INVENTION

1. Field of the Invention

The present invention relates to whip antennas mounted on vehicles such as automobiles, etc.

2. Prior Art

There are various structural types of antennas used as automobile radio antennas. Among these, one type of antenna which can be manufactured at low cost while still providing sufficient radio reception (which is a minimum requirement for such antennas) is a single-length whip antenna.

A single-length whip antenna usually includes a single, continuous rod-form conductive part which more or less matches a quarter wavelength of the FM wave band. When mounted on a vehicle, such antenna remains exposed on the outside of the vehicle body. Accordingly, high tensile materials having high recoil strength (such as high tensile strength stainless steel etc.) are used to form such an antenna so that the antenna will be able to withstand loads applied by obstructions during operation of the vehicle and/or when the vehicle is washed.

When the whip antenna is installed on a vehicle body in the assembly line, the antenna tends to occupy a relatively large space above the vehicle body. Thus, when vehicles having such an antenna installed thereon are transported, a great deal of space is wasted in order to accommodate the antenna. For this reason, the whip antennas are usually removable from the vehicle body (that is, from an attachment base which has been mounted to the vehicle body wall) via screws, etc. so as to save maximum amount of space and facilitate the transport of more vehicles.

Such antennas are, however, likely to suffer problems in that the material used to form the whip material must have a high tensile strength. However, such material is difficult to work with, and thus, it is difficult for example to cut threads thereon. As a result, it is also difficult to screw-couple such an antenna to the attachment base in an "as is" condition.

In view of these problems, a structure like that shown in FIG. 4 has been employed in the prior art. Specifically, a joint 2 is attached to the base end of a whip antenna element 1, and a male screw 3 connected to this joint 2 is screwed into a female screw 6 formed in a coupling element 5 of an attachment base 4. A material having a tensile strength lower than that of the whip antenna element 1 is used to form the joint 2 in order to secure good workability. At the same time, such material must be thoroughly sufficient in terms of strength. Accordingly, the manufacturing costs tend to be high.

In addition, there is another problem with prior art whip antennas in that even if a material of proven strength is used, the screw coupling must be in a restricted space. That is, the dimensions of the male screw portion cannot be very large. As a result, if the load (resulting from flexible bending of the whip antenna element 1) in the direction indicated by the arrow in FIG. 4 is concentrated in the screw area, the root portion of the male screw 3 may bend or break.

SUMMARY OF THE INVENTION

Accordingly, the object of the present invention is to provide a whip antenna for use in vehicles wherein a rod-form antenna element can be screw-coupled (or removably coupled) to an attachment base and the strength of the coupling section is great enough to avoid the danger of breakage, etc., even if the load of the antenna should be concentrated at the coupling section.

In order to accomplish this purpose, the present invention adopts the following structure:

A coupling member having a female screw formed on its inside circumferential surface is fastened to a rod-form antenna element near the lower end thereof. The coupling member on the rod-form antenna is prevented moving downwardly (toward the vehicle body) so that it cannot move toward the lower end of the antenna element from a certain point on the antenna element. The coupling member thus mounted on the antenna element is screw-coupled to an attachment base which is mounted on a vehicle body. Screw-coupling is accomplished by inserting the lower end of the antenna element into a hole formed in the attachment base and then screwing the female screw of the coupling member to a male screw installed in the attachment base.

With the above described structure, the base portion of the rod-form antenna element made of a highly rigid material may be used directly "as is" as a coupling core (without the necessity of a joint as conventionally required). In other words, such a base portion can be directly coupled to the attachment base. As a result, the intrinsic high rigidity and elasticity of the "whip" can be directly utilized so that the coupling strength is large and the drawbacks encountered in conventional devices is eliminated.

DETAILED DESCRIPTION OF THE DRAWINGS

DETAILED DESCRIPTION OF THE INVENTION

Figure 1:
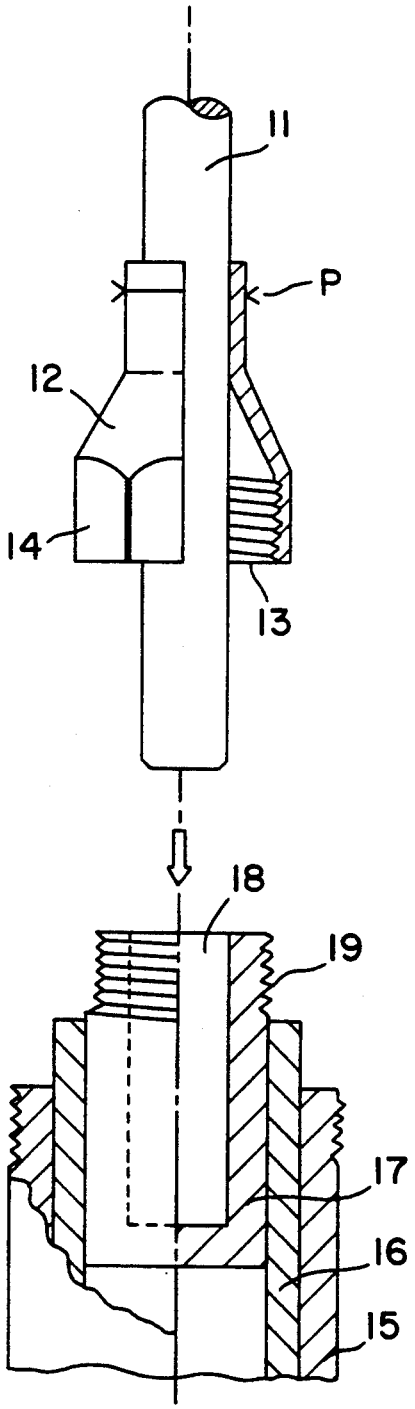
FIG. 1 is a partially cross-sectional side view which illustrates the structure of the whip antenna of the present invention.

In FIG. 1, a rod-form antenna element 11 is formed from a single, high tensile strength stainless steel rod. Alternatively, this rod-form antenna element 11 may consist of a multiple number of conductive tubes of different diameters which are telescopically connected so that the tubes are free to slide relative to each other.

A skirt-form coupling member 12 is fastened near the lower end (or base portion) of the rod-form antenna element 11. The coupling member 12 is fixed at a point P on the antenna element 11 by spot welding so that it does not move on the antenna element 11 (or it does not move to the lower end of the antenna element 11). A female screw 13 is formed on the inside circumferential surface of the skirt part of the coupling member 12.

A beveled area 14 consisting of hexagonally oriented surfaces are formed on the outside circumferential surface of the coupling member 12 so that a tightening tool can be used thereon.

Reference numeral 15 in FIG. 1 indicates an attachment base which is fastened to the vehicle body wall (not shown) beforehand. A coupling cylinder 17 is inserted into and fastened to the inside of the central portion of this attachment base 15 with an inner tube 16 interposed between the coupling cylinder 17 and the attachment base 15.

The coupling cylinder 17 has a hole 18 at the center so that the lower end of the rod-form antenna element 11 can be tightly inserted in the hole 18. A male screw 19 which engages with the female screw 13 of the coupling member 12 is formed on the outer circumferential surface of the upper end portion of the coupling cylinder 17.

The whip antenna thus constructed is coupled to the attachment base 15 (in such a manner that the antenna can be freely installed or removed) by inserting the lower end of the rod-form antenna element 11 into the hole 18 of the coupling cylinder 17 secured in the attachment base 15, and then screwing the female screw 13 of the coupling member 12 onto the male screw 19 of the coupling cylinder 17 fixed to the attachment base 15.

Thus, a highly rigid and elastic material can be used for whip element and the whip antenna can be used as a coupling core "as is" so that it is able to withstand the bending stress generated by external forces. Accordingly, the coupling strength is much stronger than conventional joints, so that no bending or breakage will occur even if a large load is applied to the antenna.

Figure 2:
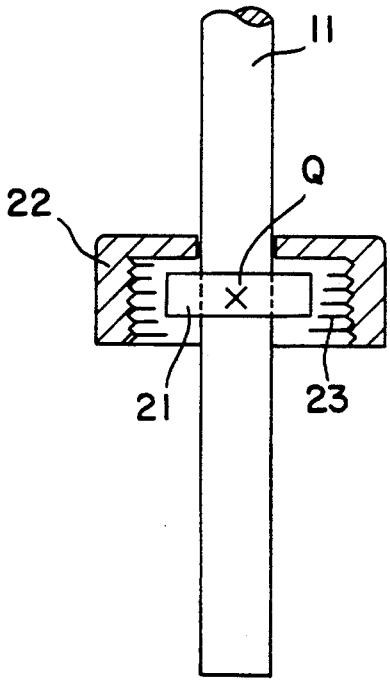
FIGS. 2 and 3 are partially cross-sectional side views which illustrate the structures of the essential parts of a second and a third embodiments of the present invention, respectively.

FIG. 2 shows another embodiment of the present invention. In this embodiment, a stopper or restrainer 21 for a coupling member 22 is spot-welded to the rod-form antenna element 11 at a point Q near the lower end of the antenna element 11. The coupling member 22 has a form of a short cylinder and is installed around the circumference of the antenna element 11 in a position which is higher than the stopper 21. Thus, the coupling member 22 is free to rotate but is prevented from moving toward the lower end of the antenna element 11 by the stopper 21. A female screw 23 is formed on the inside circumferential surface of the coupling member 22 so that it can be screw connected to the cylinder 17 of FIG. 1.

The above structure produces the same effects and has the same merits as the embodiment of FIG. 1. In addition, this embodiment has the following advantage in that even if the lower end portion of the rod-form antenna element 11 is inserted very tightly into the hole 18 (not shown in FIG. 2, see FIG. 1) so that the antenna element 11 is not easily rotated, the female screw 23 can be screwed onto the male screw 19 on the attachment base side without any difficulty by merely rotating the coupling member 22 itself.

Figure 3:
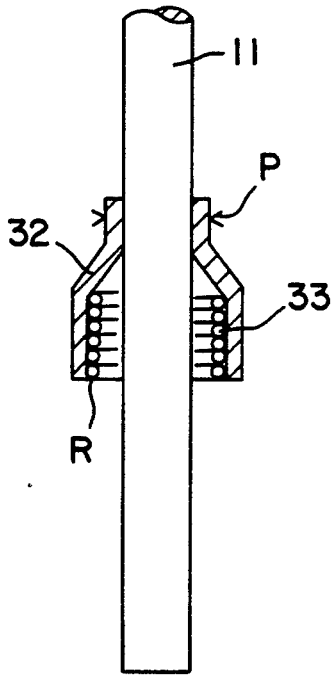
Figure 4:
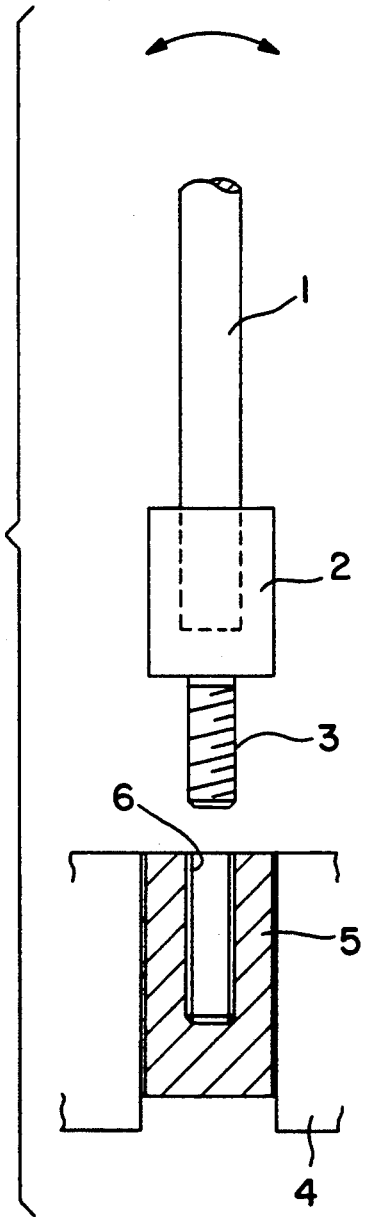
FIG. 4 PRIOR ART
FIG. 4 illustrates a prior art antenna connection.

FIG. 3 shows a third embodiment of the present invention. In this embodiment, a female screw 33 is formed by installing a helical assembly R (which is formed by coiling a wire material into a coil spring) on the inner circumferential surface of a skirt-form coupling member 32 which is fixed to the antenna element 11 at a point P by spot welding.

This structure produces the same effects and has the same merits as the embodiment illustrated in FIG. 1 as well as having an additional advantage in that there is no need for screw finishing (by cutting) on the inner surface of the coupling member 32.

The present invention is not limited to the respective embodiments described above. It goes without saying that various modifications can be made without departing from the spirit of the present invention.

As described above, according to the present invention, a coupling member which has a female screw formed on its inner circumferential surface is fastened to a lower part of a rod-form antenna element so that the coupling member is prevented from moving toward the lower end Of the antenna element. Thus, the antenna can be screw-coupled to an attachment base mounted on the vehicle body in such a way that the lower end of the antenna element is brought into a hole formed in the attachment base and then the female screw of the coupling member is screwed to a male screw provided in the attachment base. Thus, in the whip antenna of the present invention, the strength at the portion of the antenna element coupled to the vehicle body is great enough to ensure that there is no danger of breakage, etc., even if the load of the antenna element should be concentrated on the coupling section.

We claim:

1. A whip antenna for vehicles comprising:

a rod antenna element with a coupling member fixed to and electrically coupled to said rod antenna element, said coupling member having a screw thread on an inner surface of said coupling member, said coupling member being coupled to said antenna element such that said coupling member is prevented from moving toward a lower end of said antenna element at a predetermined point on said antenna element; and an antenna attachment member comprising an attachment base fastened to a vehicle body, a cylindrical hole provided in said attachment base, an inner cylinder provided in said cylindrical hole and a connecting cylinder provided in said inner cylinder, and said connecting cylinder having a central hole into which said lower end of said antenna element is inserted and a screw thread formed on its outer surface which can connect to said screw thread of said coupling member.

2. An antenna according to claim 1, wherein said coupling member is spot welded to said antenna element to prevent said coupling member from moving toward a lower end of said antenna element.

3. An antenna element according to claim 1, wherein said coupling member further comprises a restrainer securely fixed on said antenna element so as to restrain said coupling member from moving toward the lower end of said antenna element beyond said restrainer.

4. An antenna according to claim 1, wherein said screw thread of said coupling member is formed by a coiled wire fixed on an inner surface of said coupling member.

5. An antenna accordingly to claim 1, wherein said antenna element is made of high tensile strength stainless steel.

* * * * *